US005287864A

United States Patent [19]

Gallo

[11] Patent Number: 5,287,864

[45] Date of Patent: Feb. 22, 1994

[54] FROSTING FOILS

[76] Inventor: Michael Gallo, 2744 B Morris Ave., Union, N.J. 07083

[21] Appl. No.: 956,119

[22] Filed: Oct. 5, 1992

[51] Int. Cl.[5] ..... A61K 7/13

[52] U.S. Cl. ..... 132/208; 132/222; 132/270

[58] Field of Search ..... 132/208, 222, 270

[56] References Cited

U.S. PATENT DOCUMENTS

| | | | |
|---|---|---|---|
| 1,718,025 | 6/1929 | Bushinger | 132/222 |
| 3,109,438 | 11/1963 | Work | 132/222 |
| 3,349,781 | 10/1967 | Poole et al. | 132/208 |
| 3,548,842 | 12/1970 | McCall | 132/222 |
| 3,618,620 | 11/1971 | Williams | 132/9 |
| 3,749,105 | 7/1973 | Sestita | 132/208 |
| 3,861,405 | 1/1975 | Pellecchia | 132/270 |
| 3,921,647 | 11/1975 | Fisher | 132/9 |
| 3,941,613 | 3/1976 | Nicoletti | 132/9 |
| 4,196,741 | 4/1980 | Minghenelli | 132/222 |
| 4,224,954 | 9/1980 | Stahl | 132/208 |
| 4,962,775 | 10/1990 | Squatrito | 132/222 |
| 5,056,539 | 10/1991 | Abramson | 132/270 |
| 5,058,609 | 10/1991 | Sandoz et al. | 132/270 |
| 5,146,937 | 9/1992 | Lefebvre | 132/222 |
| 5,156,172 | 10/1992 | Tancredi | 132/222 |

FOREIGN PATENT DOCUMENTS

| | | | |
|---|---|---|---|
| 0126618 | 11/1984 | European Pat. Off. | 132/222 |

*Primary Examiner*—Gene Mancene
*Assistant Examiner*—Frank A. LaViola
*Attorney, Agent, or Firm*—Weingram & Zall

[57] ABSTRACT

The present invention provides a frosting foil for use in connection with frosting and/or coloring a subject's hair. The frosting foil includes a sleeve, an adhesive surface, and a backing material. The sleeve is sized to receive the tail of a tail comb so that a stylist may pick up and properly place the foil at a strand of hair desired to be treated. The adhesive attaches the foil to the strand of hair to prevent movement of the foil. Further, the adhesive permits the foil to be folded into place so that all of the foils may be placed prior to the addition of any coloring agent. After placement of the foils, each foil may be sequentially opened and a coloring agent placed on the strand of the hair contained in the foil.

12 Claims, 3 Drawing Sheets

FROSTING FOILS

FIELD OF THE INVENTION

The present invention is an apparatus and method for frosting and/or coloring hair, and more particularly to a frosting foil having a novel construction and a method of using the frosting foil.

BACKGROUND OF THE INVENTION

Coloring, highlighting and frosting hair have become popular methods of altering or accenting the color and/or look of a person's hair.

Typically, a coloring agent having a dye or bleach is painted onto a subject's hair. However, this results in the inability for a stylist to accurately control which strands of hair are colored and which are not, and could result in the running of the agent such that it contacts and damages the subject's scalp.

Other methods of coloring or frosting hair include covering the subject's hair with a cap having plurality of holes and utilizing a hook to pull strands of hair out of the cap. Once the desired strands of hair extend out of the cap, a coloring agent can be applied to those strands. However, this method is time consuming, imprecise and possibly painful to the person whose hair is being treated.

Another extensively used method of treating hair involves the use of a foil. In this case, strands of hair are separated from the subject's hair and placed on a small foil. Then, the coloring agent is applied to the hair. Then the foil is folded to enclose and encase the hair to be treated. The foil is then positioned to permit work on the next strand of hair.

There are, however, numerous problems associated with the foil method, notably, that the foil tends to move about during the application of the coloring agent thereby contacting other portions of hair and leaving a "spotted" look. Additionally, because the foil may be positioned in an upright position after application of the coloring agent, there exists the danger of seepage of the coloring agent from the foil to one's scalp. Additionally, this method prevents the stylist from viewing the placement of the foils until after the coloring agent is placed, resulting in potentially coloring too much or too little of the hair. Further, because the coloring agent is applied after each individual foil is positioned, there are frequently timing problems relating to the amount of time the coloring agent is on the hair, resulting in over processing or under processing the subject's hair. Also, there is a problem with dissipation of the strength of the coloring agent over time between application of the first and last foil.

DESCRIPTION OF RELATED ART

Many efforts have been made in the past to provide systems to simplify the process of frosting or coloring hair. Additionally, many efforts in the past have been made to control the process of coloring or frosting hair to prevent over processing hair and the problems associated with over processing hair. However, none of the previous work in this area is thought to provide the simplicity of use or the benefits of the present invention. Prior patents in this area are as follows:

U.S. Pat. No. 3,941,613 to Nicoletti discloses a hair frosting device comprising a container having a hinge at one end, which can be opened and hair placed therein. Hair can then be treated, and the container can be snapped closed while the hair is treated. The cap has a number of small apertures for pulling the hair through.

U.S. Pat. No. 3,618,620 to Williams discloses a hair curler and frosting tool having a circular base member with a spindle extending therefrom. Received on the spindle is a cage having a circular top. The apparatus may be used to bleach or to color and curl hair.

U.S. Pat. No. 5,058,609 to Sandoz et al. discloses a hair highlighting apparatus comprising a flexible liquid impermeable sheet, and a textile sheet adhered thereto. The textile sheet includes on its outer surface self-adhesive material. The sheet is placed about the hair to be treated, a treating solution is placed on the hair, and the sheet is folded over to cover the hair to be treated. The self-adhesive material contacts to adhere the material closed and on the hair.

U.S. Pat. No. 5,056,539 to Abramson discloses a product for highlighting hair comprising a segment of aluminum foil with windows of transparent material which allow the effect of the coloring agent or bleaching agent to be viewed from the exterior of the foil. Additionally, the foil contains a strip of adhesive for holding the ends of the foil together about a strand of hair.

U.S. Pat. No. 3,921,647 to Fisher discloses an apparatus for isolating and chemically treating selected bundles of hair comprising a clamp having a platform and a clip. The platform includes a pair of jaws that grab, position and hold hair to isolate selected hair from the remainder of the hair so that the selected hair may be processed.

The related art does not provide the elements of the present invention. Particularly, the related art does not show the structure of the frosting foil of the present invention, nor does it teach or suggest the method of color treating hair of the present invention, the efficiency of the method, or the benefits that result therefrom.

SUMMARY OF THE INVENTION

The present invention sets forth an apparatus and method for applying a coloring agent to a person's hair.

The apparatus of the present invention comprises a frosting foil having a sleeve formed at one end thereof and an adhesive strip applied along the sleeve. The sleeve permits the stylist to pick up and properly place the foil with the tail of a tail comb. The adhesive strip permits the foil to be maintained at the desired position along a strand of hair and permits the bottom end of the foil to be folded over and adhered to the top end of the foil to secure the foil to about a strand of hair.

The method of the present invention comprises utilizing the apparatus of the present invention as follows:

selecting a strand of hair to be treated;

selecting a frosting foil of the present invention by means of placing the tail of a tail comb into the sleeve of the frosting foil;

positioning the frosting foils using the tail of the tail comb, against the scalp along the strand of hair to be treated;

folding the frosting foil about the strand of hair to be treated such that the surface near the bottom edge of the frosting foil contacts the adhesive strip on the frosting foil and secures the frosting foil to the strand of hair to be treated;

selecting the next strand of hair and repeating the process with respect thereto until the desired amount of foils are positioned in the subject's hair;

reviewing the positioning of foils and amount of foils applied to the subject's hair to determine whether any modifications in the amount of foils used or the positioning of the foils need to be made;

opening a foil and applying a coloring agent to the strand of hair in the foil;

reclosing the foil about the hair and coloring agent by recontacting the bottom edge with the adhesive, to close the foil;

repeating the step of providing a coloring agent to the strand of hair in each foil;

allowing coloring agent to be applied to the hair for a selected time period; and removing the foil and coloring agent after the passage of the selected time period by rinsing the foils and coloring agent from the subject's hair.

According to the method of the present invention, after the frosting foils have been placed, the placement of the frosting foils can be reevaluated and changed.

OBJECTS OF THE PRESENT INVENTION

Accordingly, it is an object of the present invention to provide a novel foil for use in coloring hair wherein the foil may be grasped and positioned with the tail of a tail comb.

It is another object of the present invention to provide a frosting foil with an adhesive which adheres to hair to maintain the position of the foil.

It is yet another object of the present invention to provide a frosting foil with an adhesive which facilitates closing the foil about a strand of hair.

It is still another object of the present invention to provide a frosting foil which permits all foils to be placed on a subject's hair prior to applying the coloring agent.

It is a further object of the present invention to provide a frosting foil which is relatively simple to use.

It is even another object of the present invention to provide a frosting foil which is relatively inexpensive to manufacture.

It is also an object of the present invention to provide a method for applying a coloring agent to hair using the frosting foil of the present invention.

It is even a further object of the present invention to provide a method for coloring or frosting hair wherein all of the foils are positioned prior to using a coloring agent.

It is still a further object of the present invention to provide a method for coloring or frosting hair which allows for accurately measuring the time for which coloring agent is applied to a person's hair.

It is also a further object of the present invention to provide a method for coloring or frosting hair which is relatively easy to use.

It is yet another object of the present invention to provide a method for coloring or frosting hair which reduces seepage of the coloring agent to the subject's scalp.

These as well as further objects and advantages of this invention will become apparent to those skilled in the art from a review of the accompanying detailed description of the preferred embodiment, reference being made to the accompanying drawings.

DESCRIPTION OF THE INVENTION

Figure 1:
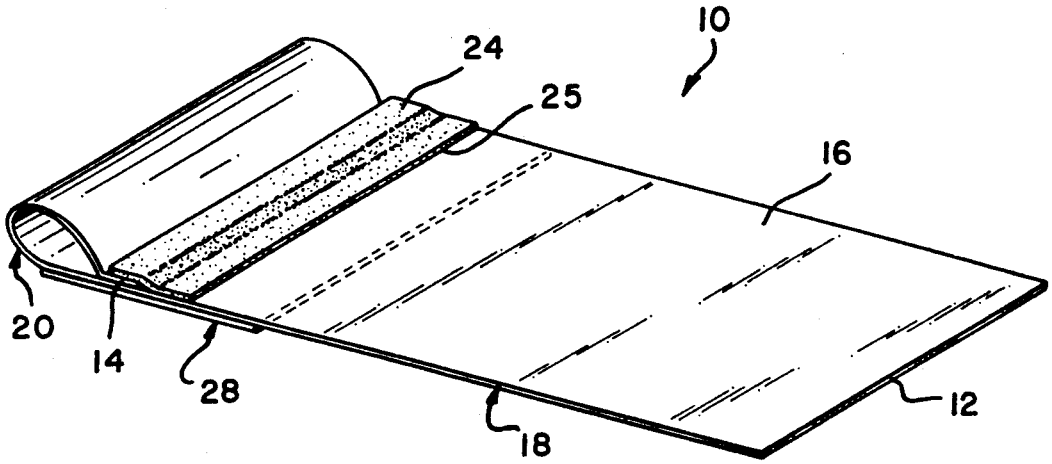
FIG. 1 is a perspective view of the frosting foil of the present invention.

The frosting foil 10 of the present invention, as shown is FIG. 1, comprises as a bottom edge 12, a top edge 14, a front surface 16 and a back surface 18. It should be noted that the term "foil" as used herein means any fluid impermeable material capable of being used, although common aluminum foil is the preferred material. Also, by a "strand" of hair, it is meant a small amount of hair from the same area on one's head. The frosting foil of the present invention can be used in connection with bleaching, frosting or coloring hair, or with any other procedure known or practiced in the art.

A sleeve 20 is formed along the top edge 14 of the frosting foil 10. Typically, the sleeve 20 is created by folding the top edge 14 against the front surface 16 of the frosting foil 10. However, the sleeve 20 could be formed in any suitable manner, including integrally with the foil strip during formation thereof. The top edge 14 may then be secured to the front surface 16 of the frosting foil 10 by means of an adhesive, typically an adhesive strip 24 which extends over a portion of the back surface 18 along the top edge 14 and additionally contacts the front surface 16 of the frosting foil 10. The adhesive strip 24 could comprise a glue or contact adhesive. It is important that the adhesive or glue used be inert with respect to the coloring agent used. Additionally, it is desirable that the glue or adhesive is water soluble to permit removal by rinsing with water.

The frosting foil 10 also includes a backing 28, secured to the back surface 18 of the frosting foil 10 along the bottom portion of the sleeve 20. The backing 28 preferably extends a distance along the bottom surface 18 approximately as far as the lower edge 25 of adhesive strip 24, although it can extend further. As such, when frosting foils 10 are positioned one on top of the other to form a stack, the adhesive strip 24 on one frosting foil 10 contacts and adheres to the backing 28 of the adjacent frosting foil 10. Therefore, it is desirable that the backing 28 has a surface that is relatively smooth and relatively non-adhesive to facilitate separation of each frosting foil 10 from the stack.

Sleeve 20 is sized to receive the tail of a tail comb to permit a stylist to use the tail of a tail comb to pick up a frosting foil 10 and to position it properly. As such, the stylist would insert the tail of a tail comb into sleeve 20 and pull the frosting foil 10 to remove it from a stack of frosting foils 10 by pulling the backing 28 from the adhesive strip 24 on the following frosting foil 10. Next, the stylist would bring the frosting foil 10 up to the strand of hair that the stylist desires to color treat. Thus, the sleeve 20 permits the stylist to use one hand to grab a frosting foil and properly position it.

Backing 28 provides reinforcement to the frosting foil 10 along the sleeve 20 and adhesive strip 24. This permits a stylist to lift one frosting foil 10 from a stack of frosting foils 10 without tearing the frosting foil 10. Likewise, backing 28 permits the stylist to open or close the frosting foil 10 after it has been positioned on a strand of hair while preventing tearing of the frosting foil.

Figure 2:
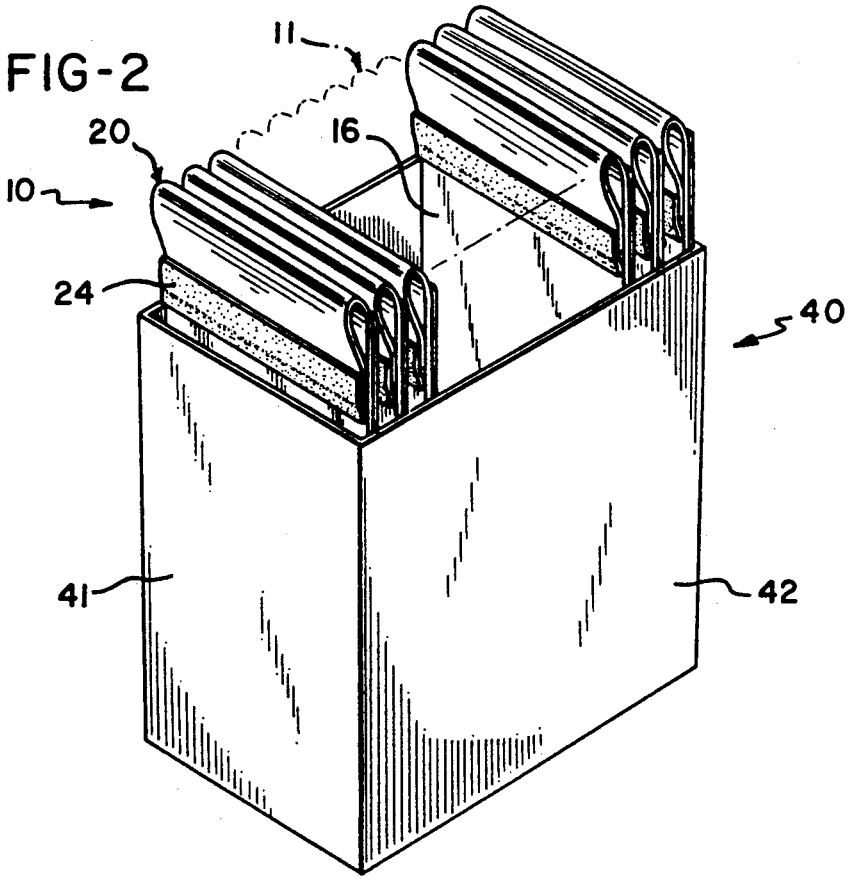
FIG. 2 is a perspective view of a stacked arrangement of a plurality of the frosting foils shown in FIG. 1 wherein the stacked stack arrangement is maintained in the boxed structure.

Shown in FIG. 2 is a stack 11 of frosting foils 10. Included in this embodiment is box 40 which serves as a container for the frosting foils 10 and protects the frosting foils 10 from damage. Box 40 is not required but is beneficial for retaining the frosting foils 10 in a stack 11. Box 40 may be of any configuration and may have an opened or partially opened front surface 41 and/or side surface 42 to facilitate removal of one frosting foil 10 from the stack 11. When the frosting foils 10 are stacked in box 40, one frosting foil 10 can be removed from the stack 11 by inserting the tail of a tail comb into sleeve 20, pulling sleeve 20 to pull the top frosting foil 10 away from the stack 11 such that the backing 28 is pulled away from the adhesive strip 24 on the following frosting foil 10. Then, depending upon the configuration of the box, the foil 10 can be pulled off of the stack 11 directly or can be slidably removed from the box 40.

Figure 4:
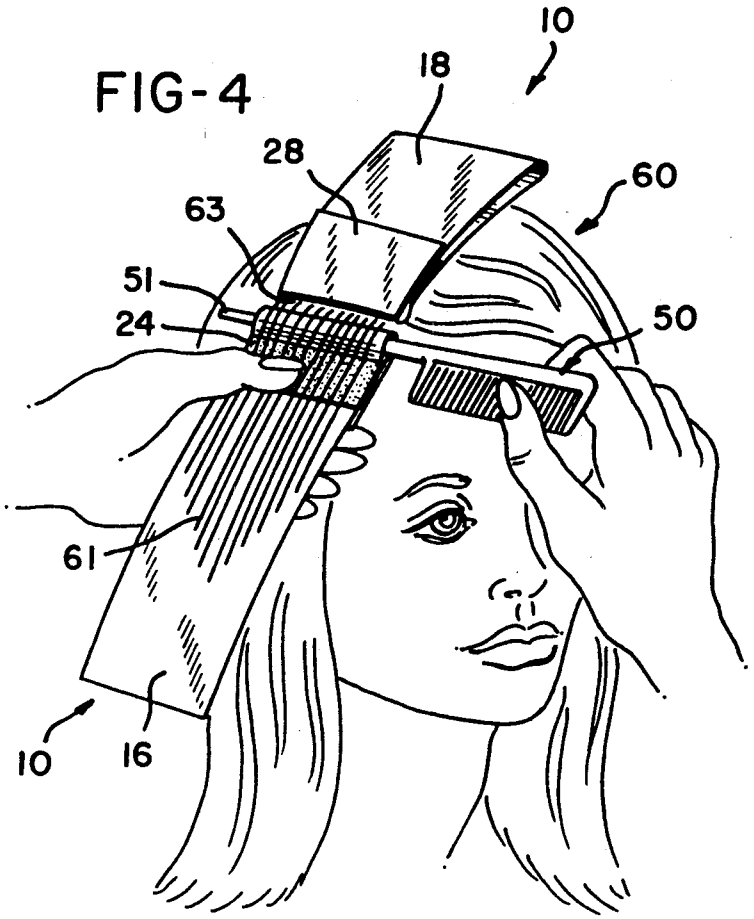
FIG. 4 is a perspective view of the frosting foil of FIG. 1 in place on a subject's head.
Figure 3:
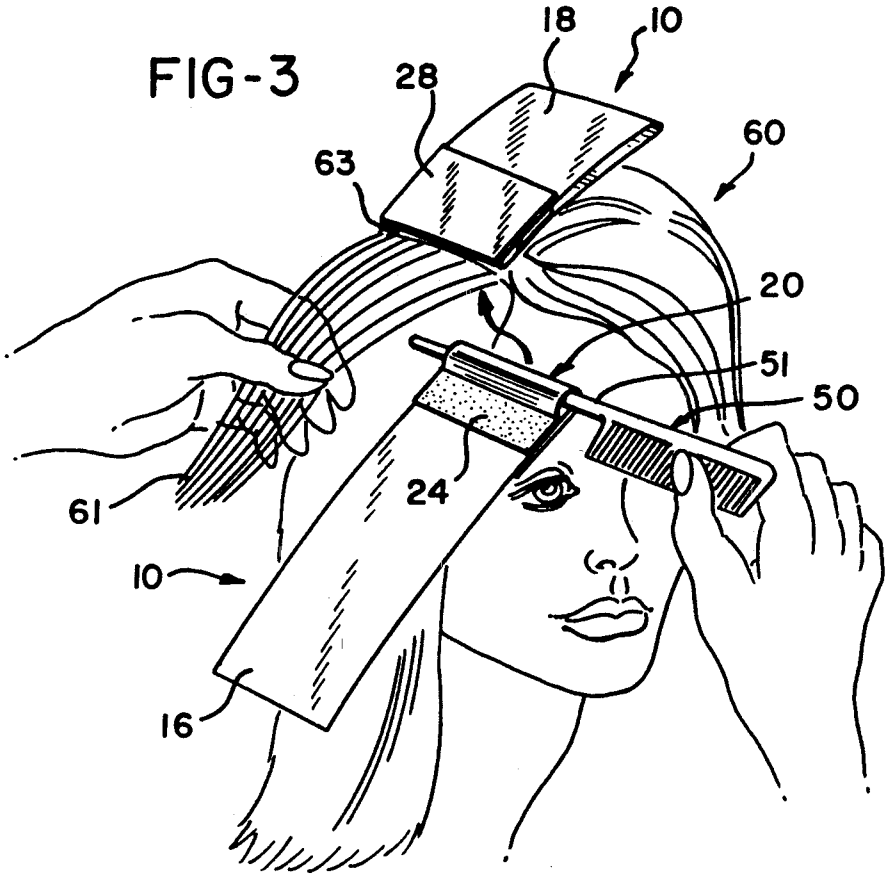
FIG. 3 is a perspective view showing the application of a frosting foil to a subject's hair.

FIGS. 3 and 4 show proper alignment and positioning of a frosting foil 10 of the present invention on a subject's head 60. After the tail 51 of a tail comb 50 is inserted into the sleeve 20 of a frosting foil 10 and the frosting foil 10 is removed from a stack 11 of frosting foils 10, the stylist uses the tail 51 of the tail comb 50 to position the frosting foil 10 underneath a strand of hair 61 to which coloring agent is to be applied. The frosting foil 10 is brought up against the scalp 63 of the head 60 of the subject. This is accomplished by pushing the tail 51 of the tail comb 50 against the scalp 63. Then the hair may be pressed down to contact the adhesive strip 24 to hold the frosting foil 10 into a proper position with respect to the strand of hair 61 to be color treated.

Figure 5:
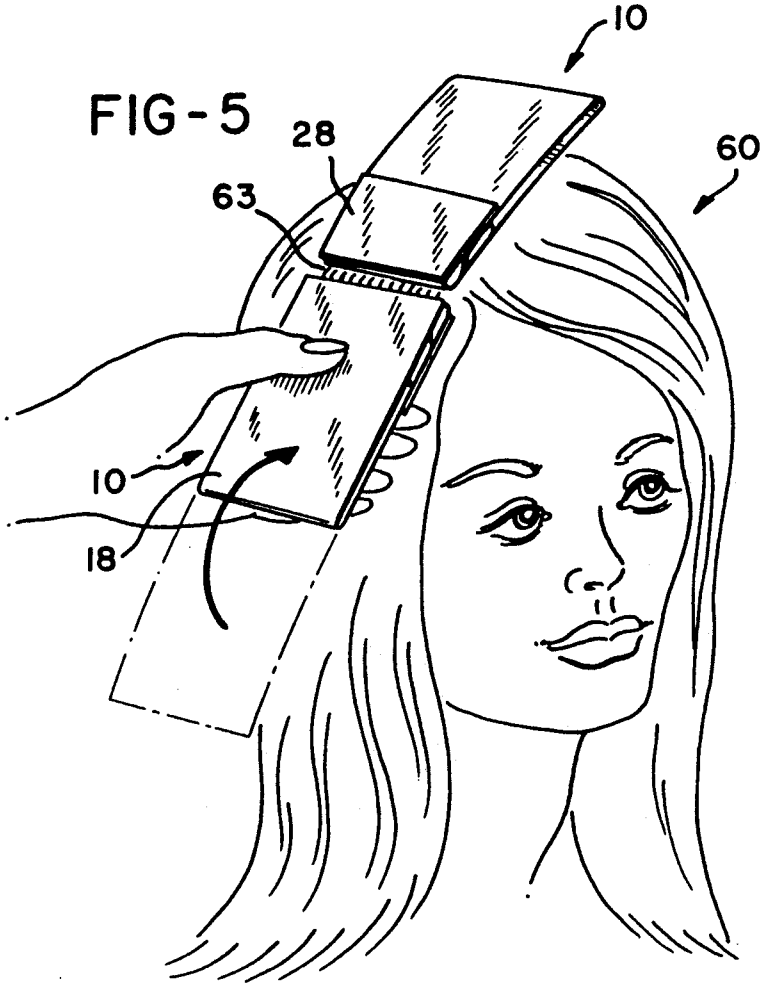
FIG. 5 is a perspective view of the frosting foil and person shown in FIG. 3 showing the frosting foil folded over upon itself.

After positioning the frosting foil 10, as shown in FIG. 5, the frosting foil may be folded over so that the front surface 16 near the bottom edge 12 of the frosting foil 10 contacts the sleeve 20 and the adhesive strip 24 to adhesively retain the frosting foil 10 folded in position about the strand of hair 61.

Figure 6:
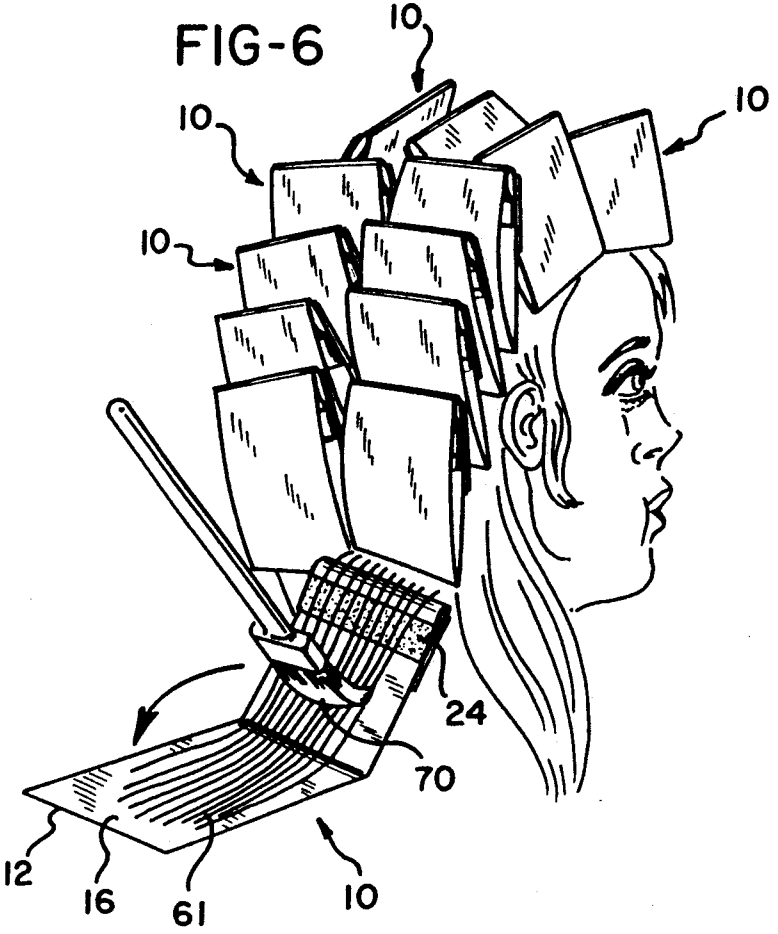
FIG. 6 shows the application of a coloring agent to a subject's hair after all the frosting foils have been placed in the subject's hair in accordance with the method of the present invention.

Shown in FIG. 6, after proper placement of the frosting foils 10, each frosting foil 10 is reopened by grabbing the bottom edge 12 and pealing the front surface 16 away from where it is adhered to adhesive strip 24 to expose the strand of hair 61 contained in the frosting foil 10. A hair coloring agent 70 is then applied to the strand of hair 61. The frosting foil is then reclosed by folding the bottom edge 12 of the frosting foil 10 over sleeve 20. This procedure is repeated sequentially for each frosting foil.

Preferably, as set forth in the method of the present invention, frosting foils 10 are applied beginning at the top of the subject's head and then progressing down along the side of the head therefrom. As shown in FIGS. 3, 4, 5 and 6, the method of the present invention for frosting or coloring hair comprises the steps of placing the frosting foils 10 in desired locations in a subject's hair beginning at the top of the subject's head and working down therefrom. After placement of the frosting foils 10, the positioning of the foils may be reviewed and altered if desired. Then, each foil is opened and the coloring agent 70 is applied to the hair 61 contained therein.

Preferably, the step of applying coloring agent 70 is best initiated with the frosting foil 10 positioned near the bottom of the subject's head so that after the coloring agent is applied, and the frosting foil 10 reclosed, the frosting foil will hang downwards from the subject's scalp to prevent seepage of the coloring agent 70 out of the frosting foil 10. After application of the coloring agent 70 to the hair for the desired amount of time, the coloring agent 70 and frosting foils 10 can be removed by rinsing the hair with warm water. The warm water will loosen on the adhesive strip 24 as well as diminish the adhesiveness of the coloring agent and permit both the foils and coloring agent to rinse from the hair.

The method of the present invention comprises utilizing the frosting foil of the present invention as follows:

selecting a strand of hair 61 to be treated;

selecting a frosting foil 10 of the present invention by means of placing the tail 51 of a tail comb 50 into the sleeve 20 of the frosting foil 10;

positioning the frosting foil 10 against the scalp 63 along the strand of hair 61 to be treated;

contacting the strand of hair 61 to the adhesive strip 24 of the frosting foil 10 to hold the frosting in place;

folding the frosting foil 10 about the strand of hair 61 to be treated such that the bottom edge 12 of the frosting foil contacts the adhesive strip 24 on the frosting foil and secures the frosting foil to the strand of hair to be treated;

selecting the next strand of hair and repeating the process with respect thereto;

continuing until the desired amount of foils are positioned in the subject's hair;

reviewing the positioning of foils and amount of foils applied to the subject's hair to determine whether any modifications in the amount of foils used or the positioning of the foils need to be made;

opening a frosting foil 10 and applying a coloring agent 70 to the strand of hair 61 in the foil;

reclosing the foil about the hair and coloring agent by folding the bottom edge of the foil against the adhesive strip to close the foil;

repeating the step of applying a coloring agent to the strand of hair in each foil;

allowing the coloring agent to be applied to the hair for a selected time period; and removing the foil and hair coloring agent after the passage of the selected time period.

It should be noted that the preferred method for placement of the foils is to begin at the top of the subject's head and to work down therefrom and that the preferred method for the application of the coloring agent is to begin at the bottom and to work up. It should also be noted, however, that the frosting foils of the present invention may be applied in any desired manner, and that however used, the frosting foil of the present invention will facilitate placement of the foils and the coloring or frosting hair.

Because a coloring agent is not immediately applied to the hair after placement of the foil thereon, the foils may be moved. Thus, one can evaluate the positioning of the foils after placement of the foils, and can change the positioning of the foils prior to adding the coloring agent. Also, because the coloring agent is not added until the end of the procedure, the stylist can break away from the subject to do other things before applying the coloring agent.

The dimensions of the foil, and the components thereof can be varied without departing from the scope of the present invention. For example, the typical size of a foil is four inches by six inches, though the length can be increased to accommodate longer hair.

While it is preferable to use a frosting foil of a disposable construction, it is within the scope of the invention to provide a reusable frosting foil. As such, the frosting foil material would be washable and the adhesive strip could be applied thereto prior to use.

The method of treating hair of the present invention, wherein first the foils are all placed, and next the coloring agent is applied, results in a quicker procedure for treating hair than the old procedure which required the coloring agent to be applied to each strand of hair after the placement of a foil on the strand of hair. Additionally, by placing all of the foils first and then applying the coloring agent, the coloring agent is applied to all strands of hair at approximately the same time, thereby allowing the stylist to accurately determine the proper amount of time to leave the coloring agent on the hair and reducing the possibility of over processing or under processing hair. Also, because the coloring agent is applied at approximately the same time, dissipation of the strength of the coloring agent is reduced, resulting in a more even treatment and a more easily controlled treatment.

Having thus described my invention in detail, it is to be understood that the foregoing description is not intended to limit the spirit and scope thereof. What is desired to be protected by Letters Patent as set forth in the appended claims.

What is claimed is:

1. An apparatus for use in separating strands of hair for color treating hair comprising:
- a web of liquid impermeable material having a top end, a bottom end, a back surface and a front surface;
- a comb tail retaining sleeve at the top end of the material for positioning the web and holding the web in position;
- adhesive means at the top end of the material on the front surface thereof;
- non-stick means on the back surface of the web positioned at least proximate to the adhesive means to allow the non-stick means to coact with the adhesive means to cover the adhesive means of an adjacent web.

2. The apparatus of claim 1 wherein the web comprises aluminum foil.

3. The apparatus of claim 2 wherein the non-stick means extends along the bottom surface of the material a distance corresponding to the adhesive means.

4. An apparatus for use in color treating hair comprising:
- a web of material having a front surface and a bottom surface;
- a comb tail retaining sleeve for positioning and holding the web;
- adhesive means positioned on the front surface of the material; and
- a non-stick backing means positioned on the bottom surface of the material extending under the retaining means and the adhesive means;
- the non-stick backing coacting with the adhesive means on adjacent webs to cover the adhesive means.

5. The apparatus of claim 4 wherein webs are arranged in a stack in a box.

6. The apparatus of claim 4 wherein the web comprises aluminum foil.

7. The apparatus of claim 6 wherein the non-stick backing extends along the bottom surface of the web a distance corresponding to the adhesive means.

8. A method for color treating hair with a frosting foil, the frosting foil having a top end with a sleeve and an adhesive strip and a bottom end, the method comprising the steps of:
- selecting a strand of hair to be treated;
- selecting a frosting foil by placing a tail of a tail comb into the sleeve of the frosting foil;
- positioning the frosting foil by manipulating the tail of the tail comb against the scalp along the strand of hair to be treated;
- pressing the strand of hair onto the adhesive strip to hold the frosting foil in place;
- folding the frosting foil about the strand of hair to be treated such that the bottom end of the frosting foil contacts the adhesive on the frosting foil and secures the frosting foil to the strand of hair to be treated;
- selecting the next strand of hair and repeating the process of securing a frosting foil thereto with respect thereto until the desired amount of foils are positioned in the hair;
- opening a foil and applying a coloring agent to the strand of hair in the foil to treat the hair;
- reclosing the foil about the treated hair;
- repeating the step of providing a coloring agent to the strand of hair in each foil;
- allowing the coloring agent to be applied to the hair for a selected time period; and
- removing the foil and hair coloring agent after the passage of the selected time period.

9. The method of claim 8 further comprising, before the step of opening a foil and applying a coloring agent, the step of reviewing the positioning of foils and the amount of foils applied to the hair to determine whether any modifications or repositioning need to be made.

10. The method of claim 9 further comprising, after the step of selecting a frosting foil, the step of removing the frosting foil from a stack of frosting foils.

11. A method of frosting hair using a frosting foil having an adhesive and a sleeve for accepting a tail of a tail comb comprising the steps of:
- grasping and positioning the frosting foils at the sleeve of the foil with the tail of a tail comb;
- placing frosting foils about strands of hair desired to be frosted;
- delivering a coloring agent to a strand of hair by opening a frosting foil, applying a frosting agent, and reclosing the foil;
- repeating the step of delivering a coloring agent to all strands of hair placed within the foils;
- permitting the coloring agent to frost the hair;
- rinsing the foils and coloring agent from the hair after a desired amount of time.

12. The method of claim 11 further comprising, before the step of delivering the coloring agent, the step of reviewing the positioning of foils and the amount of foils applied to the hair to determine whether any modifications or repositioning need to be made.

* * * * *